US010251815B2

(12) United States Patent
Garofalo

(10) Patent No.: US 10,251,815 B2
(45) Date of Patent: Apr. 9, 2019

(54) DELIVERY DEVICE AND STORAGE SYSTEM FOR OROPHARYNGEAL ADMINISTRATION OF MOTHER'S COLOSTRUM AND MILK

(71) Applicants: RUSH UNIVERSITY MEDICAL CENTER, Chicago, IL (US); NORTHSHORE UNIVERSITY HEALTH SYSTEM, Evanston, IL (US)

(72) Inventor: Nancy A. Garofalo, Chicago, IL (US)

(73) Assignee: Rush University Medical Center, Chicago, IL (US)

( * ) Notice: Subject to any disclaimer, the term of this patent is extended or adjusted under 35 U.S.C. 154(b) by 90 days.

(21) Appl. No.: 14/775,346

(22) PCT Filed: Mar. 12, 2014

(86) PCT No.: PCT/US2014/024404
§ 371 (c)(1),
(2) Date: Sep. 11, 2015

(87) PCT Pub. No.: WO2014/165105
PCT Pub. Date: Oct. 9, 2014

(65) Prior Publication Data

US 2016/0022540 A1 Jan. 28, 2016

Related U.S. Application Data

(60) Provisional application No. 61/778,882, filed on Mar. 13, 2013.

(51) Int. Cl.
*B65D 25/20* (2006.01)
*B65D 25/10* (2006.01)
(Continued)

(52) U.S. Cl.
CPC ..... *A61J 7/0053* (2013.01); *A61J 1/16* (2013.01); *A61J 7/0069* (2013.01);
(Continued)

(58) Field of Classification Search
CPC ..... A61J 7/0053; A61J 1/16; A61J 7/0069; A61J 9/00; A61J 2200/76; A61J 2205/10;
(Continued)

(56) References Cited

U.S. PATENT DOCUMENTS 1,779,451 A * 10/1930 Sponsel ..... A61M 5/3216 206/229
2,023,289 A * 12/1935 Pringle ..... A61M 5/002 206/229
(Continued)

FOREIGN PATENT DOCUMENTS

WO WO 2012/131138 A1 10/2012

OTHER PUBLICATIONS

Blencowe H et al.; "National, regional, and worldwide estimates of preterm birth rates in the year 2010 with time trends since 1990 for selected countries: a systematic analysis and implications"; Lancet, vol. 379; Jun. 9, 2012; pp. 2162-2172.
(Continued)

*Primary Examiner* — Chun Cheung
(74) *Attorney, Agent, or Firm* — Brinks Gilson & Lione

(57) ABSTRACT

A delivery system and method for storing and delivering colostrum or milk to an infant are provided. In one aspect, the system includes a syringe for delivering a dose of colostrum or milk, a swab container, and a swab. The swab is contained in the swab container and the swab container connected to the syringe. In another aspect, the delivery system includes a plurality of syringes for delivering a dose of colostrum or milk and a storage container for storing the plurality of syringes having the colostrum or milk therein.
(Continued)

The method includes loading a first syringe with a dose of colostrum or milk and placing the loaded first syringe in a first slot in a storage container. The method further includes loading a second syringe with a dose of colostrum or milk and placing the loaded second syringe in a second slot in the storage container.

11 Claims, 6 Drawing Sheets

(51) Int. Cl.
*A61J 7/00* (2006.01)
*A61J 1/10* (2006.01)
*A61J 1/16* (2006.01)
*A61J 9/00* (2006.01)

(52) U.S. Cl.
CPC ..... *B65D 25/108* (2013.01); *B65D 25/205* (2013.01); *A61J 9/00* (2013.01); *A61J 2200/76* (2013.01); *A61J 2205/10* (2013.01); *A61J 2205/30* (2013.01); *A61J 2205/60* (2013.01)

(58) Field of Classification Search
CPC . A61J 2205/30; A61J 2205/60; B65D 25/108; B65D 25/205
See application file for complete search history.

(56) References Cited

U.S. PATENT DOCUMENTS

| | | | | |
|---|---|---|---|---|
| 2,627,269 | A | 2/1953 | McGregor | |
| 5,091,316 | A * | 2/1992 | Monthony | A61B 10/02 600/569 |
| 5,129,402 | A * | 7/1992 | Koll | A61B 10/04 600/572 |
| 5,163,441 | A * | 11/1992 | Monthony | A61B 10/02 435/287.2 |
| 6,171,260 | B1 * | 1/2001 | Hochmeister | A61B 10/0096 206/569 |
| 6,254,294 | B1 * | 7/2001 | Muhar | A61M 35/006 206/572 |
| 6,617,552 | B1 | 9/2003 | Taylor | |
| 8,172,129 | B1 | 5/2012 | Laurenzi et al. | |
| 2009/0156962 | A1 * | 6/2009 | Yong | A61B 10/0045 600/569 |
| 2014/0012227 | A1 * | 1/2014 | Sigg | A61M 5/178 604/506 |

OTHER PUBLICATIONS

Caprio MC et al.; "Effects of establishing a feeding protocol to improve nutrition in premature neonates"; presented at the Pediatric Academic Societies (PAS) Annual Meeting, May 4-7, 2013; Washington, D.C.; E-PAS 2013: 3840.672.
Cole CR et al.; "Very low birth weight preterm infants with surgical short bowel syndrome: incidence, morbidity and mortality, and growth outcomes at 18 to 22 months"; Pediatrics, vol. 122, No. 3; Sep. 2008; 23 pages.
Fanaroff AA et al.; "Trends in neonatal morbidity and mortality for very low birth weight infants"; American Journal of Obstetrics & Gynecology; Feb. 2007; 8 pages.
Ganapthy V et al.; "Costs of necrotizing enterocolitis and cost-effectiveness of exclusively human-milk based products in feeding extremely premature infants"; Breastfeeding Medicine, vol. 7, No. 1; Feb. 6, 2012; pp. 29-37.
Gephart SM et al.; "Colostrum as Oral Immune Therapy to Promote Neonatal Health"; Advances in Neonatal Care, vol. 14, No. 1; Feb. 2014; pp. 44-51.
Gilbert WM et al.; "The cost of prematurity: quantification by gestational age and birthweight"; Obstet Gynecol, vol. 102, No. 3; Sep. 2003; pp. 488-492.
Hamilton BE et al.; "Annual summary of vital statistics: 2010-2011"; Pediatrics, vol. 131, No. 3; Mar. 2013; pp. 548-558.
Horbar JD et al.; "Mortality and neonatal morbidity among infants 501 to 1500 grams from 2000 to 2009"; Pediatrics, vol. 129, No. 6; Jun. 2012; pp. 1019-1026.
Martin JA et al.; "Births: final data for 2008"; National Vital Statistics Report, vol. 59, No. 1; Dec. 8, 2010; 72 pages.
Mathews TJ et al.; "Infant mortality statistics from the 2005 period linked birth/infant death data set"; National Vital Statistics Report, vol. 57, No. 1; Jul. 30, 2008; 32 pages.
McCallie KR et al.; "Improved outcomes with a standardized feeding protocol for very low birth weight infants"; Journal of Perinatology, vol. 31, Suppl 1; Apr. 2011, pp. S61-S67.
Meier PP et al.; "Improving the use of human milk during and after the NICU stay"; Clinics in Perinatology, vol. 37, No. 1; Mar. 2010; pp. 217-245.
Newburg DS et al.; "Protection of the neonate by the innate immune system of developing gut and of human milk"; Pediatric Research, vol. 61, No. 1; Jan. 2007; 7 pages.
Olsen J; "Implementation of Oropharyngeal Administration of Colostrum in the NICU"; presented at the Vermont Oxford Network Annual Meeting, Dec 3-4, 2011; Washington, D.C.
Patel AL et al.; "Impact of early human milk on sepsis and health-care costs in very low birth weight infants"; Journal of Perinatology; Jan. 31, 2013; 6 pages.
Payne, NR et al.; "Marginal increase in cost and length of stay associated with nosocomial bloodstream infections in surviving very low birth weight infants"; Pediatrics, vol. 114, No. 2; Aug. 2004; pp. 348-355.
Polin RA et al.; "Strategies for prevention of health care-associated infections in the NICU"; Pediatrics, vol. 129; No. 4; Apr. 2012; pp. e1085-1093.
Rodriquez N et al.; "Oropharyngeal administration of colostrum to extremely low birth weight infants: theoretical perspectives"; Journal of Perinatology, Sep. 4, 2008; 7 pages.
Rodriguez NA et al.; "A pilot study to determine the safety and feasibility of oropharyngeal administration of own mother's colostrum to extremely low birth weight infants"; Advances in Neonatal Care, vol. 10, No. 4; Aug. 2010; pp. 206-212.
Rodriguez NA et al.; "Randomized Clinical Trial of the Oropharyngeal Administration of Mother's Colostrum to Extremely Low Birth Weight Infants in the First Days of Life"; The Journal of Perinatology-Neonatology, vol. 24, No. 4; Jul.-Aug. 2011; pp. 31-35.
Schanler RJ; "Evaluation of the evidence to support the current recommendations to meet the needs of premature infants: the role of human milk"; Am J Clin Nutr, vol. 85, No. 2; Feb. 2007; pp. 625S-628S.
Schmitt SK et al.; "Costs of newborn care in California: a population-based study"; Pediatrics, vol. 117, No. 1; Jan. 2006; pp. 154-160.
Seigel J et al.; "Early Administration of Oropharyngeal Colostrum to Extremely Low Birth Weight Infants"; Breastfeeding Medicine, vol. 8, Issue 6; Dec. 9, 2013; 5 pages.
Sisk PM et al.; "Early human milk feeding is associated with a lower risk of necrotizing enterocolitis in very low birth weight infants"; Journal of Perinatology, vol. 27, No. 12; Apr. 19, 2007; pp. 428-433.
Steffen E et al.; "Implementing a bundle of Potentially Better Practices (PBP) to reduce NEC rate in VLBW infants"; presented at the Vermont Oxford Network Annual Meeting, Dec. 3-4, 2011; Washington DC.
Tarnow-Mordi W et al.; "Adjunctive immunologic interventions in neonatal sepsis"; Clinics in Perinatology, vol. 37, No. 2; Jun. 2010; pp. 481-499.
Thibeau S et al.; "Exploring the Use of Mother's Milk as Oral Care for Mechanically Ventilated Very Low Birth Weight Preterm Infants"; Advances in Neonatal Care, vol. 13, No. 3; Jun. 2013; pp. 190-197.
Wagner CL et al.; "Host factors in amniotic fluid and breast milk that contribute to gut maturation"; Clinical Reviews in Allergy & Immunology, vol. 34, No. 2; Apr. 2008; pp. 191-204.
Who, March of Dimes, Partnership for Maternal, Newborn & Child Health, Save the Children. Born too soon: the global action report

(56) References Cited

OTHER PUBLICATIONS on preterm birth; accessed online at www.who.int/maternal_child_adolescent/documents/born_too_soon/en/. on May 4, 2012; 128 pages.
Wilson S et al.; Oral care in the Neonate: One Step in a Bundle to Reduce Ventilator Associated Pneumonia (VAP); presented at the Pediatric Academic Societies (PAS) 2012 Annual Meeting, Apr. 28-May 1, 2012; Boston, Massachusetts. E-PAS 2012: 1519.349; two pages.
Zhang Y et al.; "Necrotizing enterocolitis requiring surgery: outcomes by intestinal location of disease in 4371 infants"; J Pediatr Surg, vol. 46, No. 8; Aug. 2011; pp. 1475-1481.
International Search Report completed Jul. 10, 2014 for International Application No. PCT/US2014/024404.
European Search Report dated Nov. 6, 2017 for European Application No. 17169321.1.

* cited by examiner

DELIVERY DEVICE AND STORAGE SYSTEM FOR OROPHARYNGEAL ADMINISTRATION OF MOTHER'S COLOSTRUM AND MILK

RELATED APPLICATIONS

This application claims the benefit under 35 U.S.C. § 371 of International Application No. PCT/US2014/024404, filed Mar. 12, 2014, which claims the benefit of U.S. Provisional Application No. 61/778,882, filed Mar. 13, 2013, which are incorporated by reference herein in their entirety.

BACKGROUND

The present disclosure relates to a delivery device and storage system for controlled administration of mother's colostrum and milk oropharyngeally to neonates, inclusive of any of the following: extremely low gestational age neonates (ELGANS: GA<28 weeks), extremely low birth weight (ELBW: BW<1000 g) infants, very low birth weight (VLBW: BW<1500 g) infants, low birth weight (LBW: BW<2500 g) infants, premature (GA<37 weeks) infants, or other "at risk" term infants. Although the delivery device and storage system for oropharyngeal administration of mother's colostrum and milk is designed for use with any neonate, the infants that would derive the most benefit are premature infants, particularly those that are VLBW; weighing less than 1500 grams at birth.

Worldwide, up to 18 million infants are born prematurely.[1, 2] Of these infants, 84% are born between 32 and 36 weeks gestational age (GA), 10% are born between 28 and 32 weeks GA, and 5% are born at less than 28 weeks GA.[1, 2] In the United States, approximately 550,000 infants are born premature (GA<37 weeks) annually[3, 4] This represents one out of every 8 infants born in the U.S. The incidence of preterm birth has increased significantly since 1990, as a result of reproductive technologies. Survival of extremely premature infants has also increased dramatically in recent decades as a result of advances in neonatal medicine and technology. Recent data shows that >85% of VLBW infants born in the United States will survive to discharge.[5, 6] Very low birth weight (VLBW: BW<1500 g) infants represent only 1.5% of all lives births in the United States,[7] yet account for approximately $13.4 billion annually; 30% of total newborn healthcare costs in the U.S.[8-10]; largely as a result of infectious morbidities. The smallest of the VLBW infants are born before the last trimester of pregnancy. These immunodeficient infants sustain long hospitalizations (up to 4 months) in the pathogen-laden neonatal intensive care unit (NICU), while requiring numerous invasive devices for the provision of life-saving therapies. These factors place them at high risk for acquiring several episodes of device-associated healthcare-associated infections (DA-HAIs), including blood-stream infection and ventilator-associated pneumonia (VAP), during their prolonged NICU stay.[11] Necrotizing enterocolitis (NEC), while not a DA-HAI, is another potentially lethal (gastrointestinal) infectious and inflammatory disorder for the VLBW infant. The mortality associated with blood-stream infection, ventilator-associated pneumonia, and necrotizing enterocolitis is high (10-49%)[12] for these extremely premature infants. Survivors suffer from long-term handicapping morbidities, including severe neurological impairments which create a massive financial burden for families, healthcare systems, educational systems, and society. A 25% reduction in the incidence of blood-stream infection for extremely premature VLBW infants could yield a saving of 24 million dollars annually.[13] The total additional hospital costs associated with necrotizing enterocolitis have been estimated to be 6.5 million per year. Prevention of a single case of surgical necrotizing enterocolitis could reduce the financial burden of prematurity in the U.S. at an approximate savings of $125,000 per case; conservatively.[14, 15] While the complete elimination of blood-stream infection, ventilator-associated pneumonia and necrotizing enterocolitis is not possible with the increased survival of extremely premature infants, and the high incidence of device utilization in the NICU, even a modest reduction in the incidence of these infections could yield a substantial cost savings in health dollars, and improved health outcomes for these vulnerable infants. The development of safe, cost-effective, and efficacious preventative strategies, including adjunctive immunologic interventions is an urgent priority.[16]

Own mother's milk (OMM) feedings have been consistently linked with a lower incidence of infections for preterm infants.[17-21] This protection is attributed to a multitude of milk biofactors which provide passive immune protection, modulate the infant's mucosal and systemic immune responses, and promote intestinal maturation. The milk expressed by women who deliver extremely premature infants is more highly concentrated in protective (immune and trophic) biofactors, (also present in amniotic fluid), compared to the milk expressed by women who deliver at term. These gestation-specific trends in composition are especially pronounced in early milk (colostrum) which suggests an important biological function for protecting the extremely premature infant from infection during the first weeks of life and facilitating extra-uterine transition.[22]

Mother's milk is administered to extremely premature infants (i.e. ELBW, ELGANs, VLBW) as an enteral "feeding" via a nasogastric tube. However, clinical instability precludes enteral feedings for extremely premature infants in the first 2 weeks of life. This post-birth fasting leads to intestinal atrophy and abnormal intestinal colonization which increases the risk for feeding intolerance, blood-stream infection and necrotizing enterocolitis. Once feedings are started, extremely premature infants typically require many weeks to reach full enteral feedings (150 mL/kg/day) because the immature gastrointestinal tract makes tolerating feedings problematic. The prolonged time to reach full enteral feedings necessitates the long-term placement of central venous catheters for the administration of parenteral nutrition; significantly increasing the risk for acquiring blood-stream infection and necrotizing enterocolitis. Because enteral feedings are given via a nasogastric tube for many weeks, stimulation of the infant's oropharyngeal-associated lymphoid tissue (OFALT) by protective (immune and trophic) biofactors in mother's milk, cannot occur until the infant is developmentally ready to begin "per oral" feeds at 32 weeks post-conception. Therefore, for up to 9 weeks post-birth (for infants born as early as 23 weeks gestation) the infant's oropharynx is not exposed to protective biofactors because enteral feedings are given via a nasogastric tube which bypasses the oropharynx. In a normal term pregnancy, in-utero stimulation of the oropharynx is provided until 40 weeks gestation by protective immune and trophic biofactors present in amniotic fluid.[23] With a preterm delivery however, amniotic fluid exposure stops abruptly and with our current standard of care, OFALT stimulation is delayed for up to 2 months for extremely premature infants. Importantly, if formula (and not mother's milk) is used for per oral feedings, then the infant's OFALT will never again be exposed (post-birth) to immune and trophic biofactors. The delayed (or absent) exposure post-birth to protective milk biofactors is a critical barrier to optimizing outcomes for extremely premature infants, and a clinical dilemma for NICU's not only in the United States, but world-wide. The immune and trophic benefits of mother's milk underscore the urgent need to test strategies to facilitate early exposure to milk biofactors, even when the infant cannot be fed. Oropharyngeal administration of mother's colostrum and milk is an innovative intervention that has been recently introduced clinically, however the proper delivery device and storage system for this intervention is not yet available to clinicians who care for high-risk infants in the NICU.

Oropharyngeally-administered mother's colostrum and milk can be utilized as an adjunct immunological intervention to protect recipient infants against infections, including blood-stream infection, ventilator-associated pneumonia, and necrotizing enterocolitis. During oropharyngeal administration,[22] small drops of milk are placed directly onto the oral mucosa, followed by gentle buccal swabbing to evenly distribute the milk. Oropharyngeally-administered mother's milk with buccal swabbing may protect the recipient infant against infection via (1) cytokine interaction with immune cells within OFALT (2) passive mucosal absorption of protective immune and trophic factors such as lactoferrin and epidermal growth factor, and (3) barrier protection against oropharyngeal pathogens via the activities of secretory immunoglobulin A and lactoferrin. Our pilot studies[24, 25] established feasibility for this natural, easy, inexpensive intervention. Our data suggest that infants who receive this intervention may have enhanced immunocompetence and may reach full enteral feedings earlier,[25] and that their mothers may have enhanced lactation and breastfeeding outcomes. Emerging data suggests additional benefits of oropharyngeal mother's milk, with and without buccal swabbing, including protection against blood-stream infection, ventilator-associated pneumonia, and necrotizing enterocolitis, earlier attainment of full enteral feeds (which can lead to a decreased length of hospitalization), enhanced maturation of oral feeding skills, improved growth, and enhanced breastfeeding outcomes.[26-33]

Because it is an easy, natural, cost-effective intervention, oropharyngeal administration of own mother's colostrum and milk is quickly becoming standard care in NICUs through the United States. Some centers are providing the intervention every 2 hours for a 48-hour treatment period in the first days of life, while other centers are prolonging the duration of treatment from several days to several weeks. For the tiniest infants born as early as 23 weeks gestation, oropharyngeal administration of mother's milk may be given for a prolonged duration; up to 2 months, in order to mimic the effects of amniotic fluid exposure in the oropharynx, until per oral feedings are started at 32 weeks post-conceptional age. While these practices are quickly being incorporated into standard care, the delivery device and storage system for oropharyngeal administration of mother's colostrum/milk is not available. Because of this, clinicians (nurses and physicians) are utilizing a variety of different supplies (often unsterile) to administer the milk, and wide variation in the administration procedure itself may actually jeopardize patient safety.

The use of a cotton swab, dipped into a container of milk, prior to oropharyngeal administration, is common practice. This raises several concerns. First, the cotton fibers may become dislodged and aspirated during the (oropharyngeal administration of milk) procedure. If the cotton swab is completely saturated with milk, the entire (swab) head may become dislodged and aspirated; a medical emergency. While swabbing, the cotton swab creates friction to the fragile oral mucosa, that may result in breakdown and possible infection. Because the swab absorbs the majority (up to 97%) of the (milk) volume, the "dose" that is administered to the infant is widely variable, and inconsistent with subsequent doses. Finally, repeatedly dipping a cotton swab into a container of milk in preparation for each treatment may introduce pathogens into the milk and places the infant at risk for infection. Without an organized storage system, there is an increased likelihood that syringes (when prepared beforehand) may become contaminated or may not be used in the proper sequence. The present system allows for embodiments where the "doses" may be given in the same order that the milk was expressed, in order to maximize immune protection for the infant. An organized system allows for upright storage of syringes, in consecutive order so that the doses may be administered appropriately, and this system also permits nurses to easily find the next dose for more efficient use of time.

A standardized delivery device and storage system will enable clinicians to administer a precise "dose" of mother's colostrum and milk to the infant, using a standardized system to maintain sterility and promote patient safety. Because this treatment may be administered for a prolonged duration during the infant's hospitalization, a standardized delivery device and storage system is needed in order to ensure that all doses are administered as planned, and that infection-control practices are maintained. For example, for the smallest premature infants born at 23 weeks gestation, as many as 1008 doses (504 treatments; 2 syringes per treatment) may be administered during the infant's hospitalization. In some embodiments, the infant typically receives 24 treatments (of oropharyngeal colostrum) administered every 2 hours within the first 48 hours of life, which equals 48 doses since each treatment includes 2 syringes; one "dose" of milk for each cheek (i.e. one dose for the right buccal mucosa, and one for the left buccal mucosa). Thereafter, the infant may receive treatments every 3 hours (8 treatments per day; 2 doses per treatment) of oropharyngeal mother's milk daily, for a period of 9 weeks (63 days) until the infant reaches a post-conceptional age of 32 weeks; the earliest time when per oral feedings can be safely initiated for a preterm infant. If an infant is too clinically-unstable to begin per oral feeds at this time, the treatment period would be prolonged further and more doses would need to be prepared daily.

In some embodiments, fresh, never frozen, mother's milk may be used for this intervention in order to provide the infant with the highest concentration of (immune and trophic) protective biofactors. In the absence of fresh milk however, previously frozen mother's milk, and also donor breastmilk may be used. The use of fresh, never-frozen milk would enable the nurse to prepare several days worth of doses for oropharyngeal administration of mother's milk. For example, fresh milk can remain refrigerated for 48-72 hours, based on the hospital protocol. If not used within this period, it should be frozen so that it does not expire. Using the storage device disclosed herein, a nurse could prepare a total of 24 syringes for the infant, which would provide either 24 'single-syringe' doses, or 12 'double-syringe' doses. If an infant is receiving treatments every 2 hours (first 48 hours of life) the storage system can store enough "doses" for a 12 or a 24-hour treatment period. When the infant is receiving treatments every 3 hours, the storage system can store up to 3 days worth of "doses" when using a single-syringe system. The storage system disclosed herein reduces the risk for pathogen contamination during storage; decreasing infection risk for the infant.

The infants that would derive the most benefit from this intervention are very-low-birth-weight infants (VLBW: BW<1500 g) which account for 1.5% of all births in the United States; approximately 64,500 VLBW infants were born in 2007. On average, each VLBW infant would receive 392 treatments during hospitalization in the NICU, with calculations as follows; Initial treatment period: q 2 hour treatments×48 hours=24 treatments per subject, followed by the Extended treatment period: q 3 hour treatments×46 days on average (63 days for 23 wk infants, 28 days for 28 wk infants)=392 treatments; 784 doses per VLBW infant. This represents a total of 50,568,000 doses (syringes) for VLBW infants born in the United States annually. The delivery device and storage system of the present disclosure can be adapted for use with low birth weight (LBW: BW<2500 g) infants, which represent approximately 8.3% of all U.S. births annually and with any "at risk" term infant who is unable to breastfeed or feed 'per oral' from a bottle, as described below.

BRIEF SUMMARY

A delivery system for delivering colostrum or milk to an infant is provided. In one aspect, the system includes a syringe for delivering a dose of colostrum or milk, a swab container, and a swab. The swab is contained in the swab container and the swab container connected to the syringe.

In another aspect, the delivery system includes a plurality of syringes for delivering a dose of colostrum or milk and a storage container for storing the plurality of syringes having the colostrum or milk therein.

In another aspect, a method for storing colostrum or milk for delivery to an infant is provided. The method includes loading a first syringe with a dose of colostrum or milk and placing the loaded first syringe in a first slot in a storage container. The method further includes loading a second syringe with a dose of colostrum or milk and placing the loaded second syringe in a second slot in the storage container.

DETAILED DESCRIPTION

Figure 1:
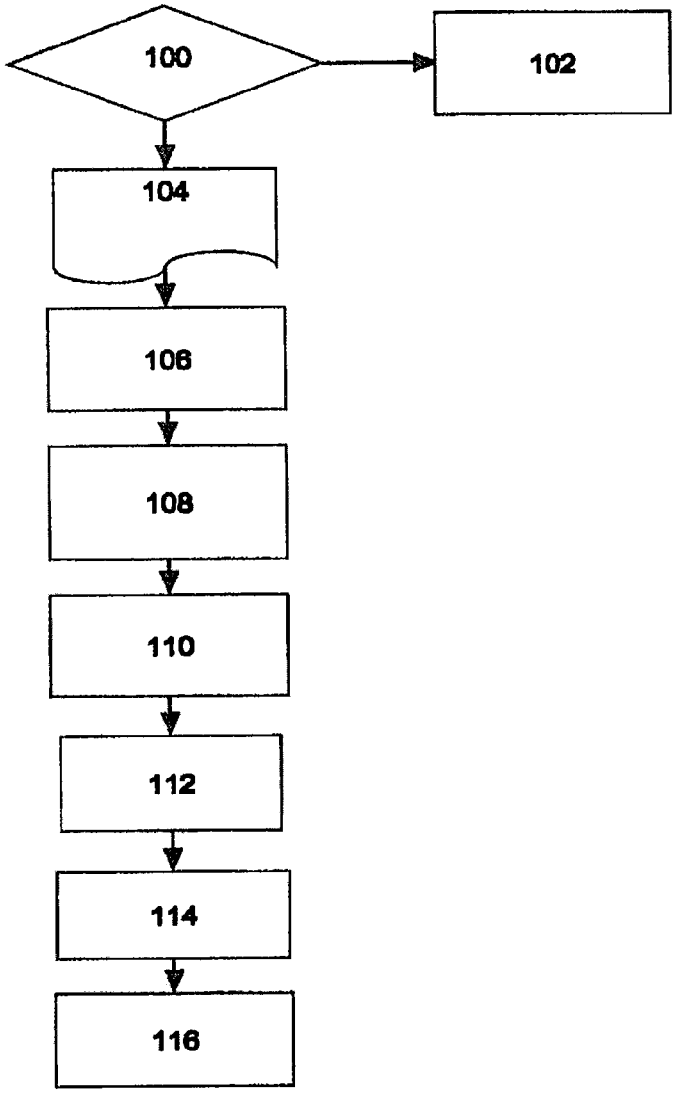
FIG. 1 shows a flow chart of the delivery system for administration of mother's colostrum and milk

The invention is described with reference to the drawings in which like elements are referred to by like numerals. The relationship and functioning of the various elements of this invention are better understood by the following detailed description. However, the embodiments of this invention are not limited to the embodiments illustrated in the drawings. It should be understood that the drawings are not to scale, and in certain instances details have been omitted which are not necessary for an understanding of the present invention, such as conventional fabrication and assembly.

The delivery device and storage system described herein is designed to permit the delivery of specific doses of colostrum/milk corresponding to the infant's birthweight, in a highly controlled manner, where the likelihood of milk contamination with pathogens is greatly reduced. Additionally, the risk of exposing the infant to another mother's milk, or to an expired dose of milk, is reduced, promoting patient safety. Finally, because the system is highly organized and facilitates proper sequencing of subsequent doses, nursing time can be decreased as well.

The delivery device and storage system described herein can be configured for use with extremely low birth weight (ELBW: BW<1000 g) or very low birth weight (VLBW: BW<1500 g) or extremely low gestational age neonates (ELGANs; GA<28 weeks). Although many of these infants do not have a breathing tube in place and are therefore not "intubated" during the first days post-delivery, they also are often too clinically unstable to tolerate enteral feedings which makes the oropharyngeal administration of own mother's colostrum/milk an attractive alternative to provide these infants with immune protection while they are still not fed enterally ("nil per os" or NPO). The methods and devices disclosed herein provide a precise and limited volume of mother's colostrum/milk to these infants, reducing the likelihood that these infants would not tolerate the volume even if not intubated. Because premature infants would not have a gag reflex until at least 32 weeks post-conceptional age (up to 8 weeks post-birth for ELBW infants), the risk of volume intolerance and/or aspiration is a valid concern. Limiting the volume that may be administered through use of this device significantly lessens this risk and promotes patient safety.

The delivery device and storage system of the present disclosure can be adapted for use with low birth weight (LBW: BW<2500 g) infants, which represent approximately 8.3% of all births in the United States annually. In the United States, approximately 550,000 premature infants are born yearly, and the delivery device and storage system of the present disclosure could be utilized during each infant's hospitalization, based on the number of treatments prescribed by the attending physician.

The delivery device and storage system of the present disclosure can be adapted for use with any infant in the NICU, including those of term gestation, who are unable to breastfeed for various reasons. Some of these infants are too unstable from respiratory or cardiac disease which precludes breastfeeding, while others are unstable because of neurological disorders and are too weak to feed at the breast. These term infants, suffering from respiratory, cardiac and neurological disorders are typically fed via gavage utilizing a nasogastric or orogastric tube which bypasses the infant's oropharynx and delivers milk directly into the infant's stomach. While gastric feedings serve to provide the infant with necessary nutrition, the potential immunostimulatory effects of immune biofactors, such as milk cytokines, on the infant's OFALT are not afforded because the OFALT structures are bypassed. Experts believe that the stimulatory effect of milk cytokines on the breastfed infant's OFALT system is an important immunoprotective mechanism; which provides immune-modulation and protects the recipient infant against infection. Thus the delivery device and storage system for the oropharyngeal administration of mother's colostrum and milk can be utilized individually when infants are not fed enterally (NPO) or in combination with nasogastric or orogastric feedings (which enter the stomach and bypass OFALT) in order to stimulate the infant's OFALT system.

The delivery device and storage system of the present disclosure can also be adapted for use with donor milk or banked milk. Donor milk undergoes strict screening and pasteurization procedures, and it is utilized in NICUs throughout the United States, for feedings, when own mother's milk is not available or insufficient to meet the infant's (feeding) volume needs. Donor milk is also a viable substitute for mother's colostrum and milk, when administered oropharyngeally.

The present disclosure relates a delivery device and storage system for the oropharyngeal administration of mother's colostrum and milk. The delivery system provides a mechanism for precise delivery of a measurable "dose" of own mother's colostrum or milk, administered oropharyngeally to include gentle swabbing of the infant's buccal mucosa to allow even and thorough spread of the colostrum/milk, while reducing the risk of contamination and/or irritation to the fragile oral mucosa. Such a system significantly reduces the risk that pathogenic organisms would be introduced into the infant's oral mucosa; potentially causing infections such as ventilator-associated pneumonia which is a costly nosocomial infection; associated with significant morbidity and mortality for ELBW, VLBW, LBW and other at risk infants.

One aspect of the present disclosure is a closed system for precise administration of a specified "dose" of own mothers colostrum/milk. The delivery system includes a sterile micro-syringe with a total capacity of 1.0 mL or less. An exemplary syringe of this type includes the Baxa ExactaMed Oral syringe (Baxter, Deerfield, Ill.). The dispenser tip is designed to prevent wrong-route (i.e. intravenous) administration and to promote patient safety. The total volume of the syringe may be about 1.0 mL or less to reduce the risk of inadvertently administering a large volume that would not be tolerated and could potentially cause a premature infant to choke. A small cap is attached to the syringe. A syringe like device, small outer chamber or other container attached to the syringe and containing a cap accommodates one or more small sterile swabs which have minimal absorbency and can slide out of the outer chamber for a single one-time use. An exemplary swab that is ideal for this use is the Plak-Vac Petite Swab (Trademark Medical LLC, St. Louis, Mo.), made of non-reticulated foam. The preferred swab is made of a low absorbency material that has a low pore size (e.g. 100 pores per inch or less) and has a smooth surface. A smoother surface reduces the frictional irritation to the oral mucosa, reducing the risk for injury. This is especially important when swabbing the fragile oral mucosa of an extremely premature infant, as it is highly vulnerable to injury with even the slightest amount of friction.

The micro-syringe is transparent and allows the user to visualize the contents. The markings are clearly labeled and units are small 0.05 to 0.1 mL up to a total volume of 1.0 mL. The 0.5 mL syringe may be used for premature infants, while the 1.0 mL syringe may be used for term infants. The micro-syringe can include hangers configured to keep the syringe upright in a storage component to minimize contamination. The storage component permits the upright storage of twenty-four micro-syringes, to provide twenty-four (single-syringe) treatments of oropharyngeal administration of colostrum, administered every two hours for a total "treatment protocol" of 48 consecutive hours. Thereafter, the treatments can be given every three hours for many weeks, until the infant begins per oral feedings. The storage component permits the upright storage of sixteen or twenty-four micro-syringes, to provide 2-3 days worth of ('single-syringe' every 3 hour) treatments, based on hospital policy for use of fresh-never frozen milk. Further, the storage system can include labeling allowing for the easy determination of the next sequential "dose" of colostrum/milk. This eliminates the risk of administering an "expired" dose, eliminates the waste of colostrum/milk, and minimizing the nurse's time in finding the next dose quickly. This aspect is useful for avoiding waste and adhering to hospital protocol which states that colostrum/milk should be administered within about 24 hours of thawing (if previously frozen) or within about 48-72 hours of expression (if fresh; never frozen).

Another aspect of the present disclosure is a dosing method for the delivery of a precise, predetermined amount (in mLs) of colostrum/milk. The dose of colostrum/milk should be adjusted based on the infant's gestational age and birth weight. For the smallest infants, a miniscule volume is required. The dosing method includes the steps of providing a micro-syringe to draw up in a sterile manner a predetermined volume of mother's colostrum/milk (or donor milk), with the markings clearly indicating 0.05 mL increments. The colostrum/milk within the micro-syringe is exposed within the syringe. During the delivery, the cap is removed and the tip of the syringe is placed inside the infant's mouth. By way of non-limiting example, the syringe may be gently placed alongside the right buccal mucosal tissue (right cheek), and directed posteriorly. The volume of colostrum/milk may be slowly administered. The swab may be used to spread the colostrum/milk over the oral mucosa over a period of at least 5 seconds. The (first) syringe is discarded immediately after the treatment is administered. If a second dose is delivered, the cap from a second syringe is removed and the tip of the syringe is carefully placed inside the infant's mouth, this time alongside the left buccal mucosal tissue (left cheek), and directed posteriorly towards the oropharynx. The volume of colostrum/milk is slowly administered. The swab may be used to spread the colostrum/milk over the oral mucosa for at least 5 seconds. The second syringe is discarded immediately after the treatment is administered. The use of two separate syringes ('double-syringe'-one for each cheek) is the preferred method, especially in the case of extremely premature infants, where miniscule volumes are administered. Using a separate syringe for each side ensures that the volume ("dose") is administered per side is measurable, and also reduces unnecessary stimulation that can occur when switching sides, and minimizes friction to the oral mucosa. For term infants, two separate syringes may be used. Alternatively, a single syringe may be used, in which case the (milk) volume is doubled and a single swab is used for both cheeks.

Referring to FIG. 1, a flow chart for the process is described. Upon the delivery of an infant, the management team (led by a qualified physician) determines if the infant is "at risk" 100 including but not limited to a premature, ELBW, VLBW, ELGAN, LBW, immunodeficient patient or 'at risk' term infant who is unable to feed due to illness. If the determination is that the patient is not at risk, then the patient is treated using standard and well established procedures 102 for the patient. If the determination is that the patient is at risk, then an appropriate protocol is prepared 104 for the specific patient and birth mother using protected (HIPAA) patient identifiers and health information. The management team will educate the birth mother on the procedure and obtain any consent that may be required under the hospital's standard operating procedures (SOP). By way of non-limiting example, description of the protocol and the device embodiments will refer to own mother's colostrum (OMC) however, own mother's milk or donor colostrum or donor milk may also be used with the protocol and device embodiments described herein.

Once consent is received (if required by a hospital's protocol), the birth mother expresses colostrum (OMC) into a sterile container 106 using a breast pump (Medela US, McHenry, Ill., or similar manufacturer) or via manual expression. A member of the management team will draw about 0.1 mL, 0.2 mL up to 0.5 mL of OMC for a premature infant, or up to about 1.0 mL for a term infant, based on the infant's weight, into each of a plurality of sterile, disposable syringes (Becton, Dickinson and Co., Franklin Lakes, N.J. or similar manufacturer), and place a sterile cap on the syringe 108. By way of non-limiting example, 24 individual syringes may be filled. The volume of OMC drawn into the syringe may also be about 0.20 mL, 0.25 mL, 0.30 mL, 0.35 mL, 0.40 mL, 0.45 mL or greater depending on the desired delivery volume for the infant. The number of syringes may be 1, 2, 5, 10, 11, 12, 13, 14, 15, 16, 17, 18, 19, 20, 21, 22, 23, but are typically 24, 25, or 26 with 24 being the common protocol. The syringes may be stored upright with the capped tips oriented in a downward facing direction in a storage container that is labeled with the patient and birth mother identifiers contained in the protocol. The storage container may include individual slots or compartments for each syringe so that the individual syringes are not in contact with one another.

According to the OMC delivery schedule outlined in the protocol 104, a filled syringe is removed from the storage container and a precise volume of OMC is delivered to an infant's oropharyngeal cavity 110 using the syringe. In some embodiments, the volume of OMC may be delivered directly onto the tip of a sterile polyurethane foam swab (Trademark Medical LLC, St. Louis, Mo.) or cotton swab (Puritan Medical Products Co, LLC, Guilford, Me. or similar manufacturer) and delivered to the oropharyngeal cavity of the infant. Where the volume of OMC is delivered by syringe, a swab may be used to distribute the OMC. In some embodiments, the swab is immediately and gently swiped on one side of the infant's oropharyngeal cavity 112 to distribute the OMC evenly. It is important to deliver the OMC quickly to avoid loss due to absorption into the cotton/polyurethane tip of the swab. In some embodiments, the swab may be reused to deliver another equal volume to the other side of the infant's oropharyngeal cavity 114. Alternatively, a fresh sterile swab may be used for the other side. In some embodiments, the volume of OMC is distributed to the buccal mucosa (cheek) of the oropharyngeal cavity.

In some embodiments, the volume of OMC delivered to each cheek is about 0.10 mL but the volume can be adjusted by the weight of the infant and can include about 0.05 mL, 0.15 mL, 0.20 mL, 0.25 mL, 0.30 mL, 0.35 mL, 0.40 mL, 0.45 mL, or 0.50 mL. The preferred OMC administration schedule is every two hours for a period of 48 hours after birth but the schedule and period can be adjusted as determined by the management team, and can occur every half hour, every hour, every three hours or every four hours for periods that include 12 hours, 24 hours, 36 hours or longer, or many days, or many weeks during the infant's hospitalization. In some embodiments, the volume of OMC that is delivered may change over time. The volume of OMC may increase, decrease or stay the same through the course of the protocol Throughout the process the patient is monitored 116 per the SOP for the NICU. If any complications caused by the administration of the OMC appear, the process may be delayed or discontinued as determined by the management team.

It should be noted that although this system was designed for humans, the system and devices described herein can be used in any preterm or LBW mammal, wherein a veterinary specialist would determine the need for and schedule of delivery of OMC from the preterm animal's mother or a qualified donor mammal of the same species. Use of this system and the accompanying devices in veterinary offices, zoos and wildlife sanctuaries can improve the prospects for successful rearing of at risk animals and can improve the potential for repopulating endangered species.

Figure 2:
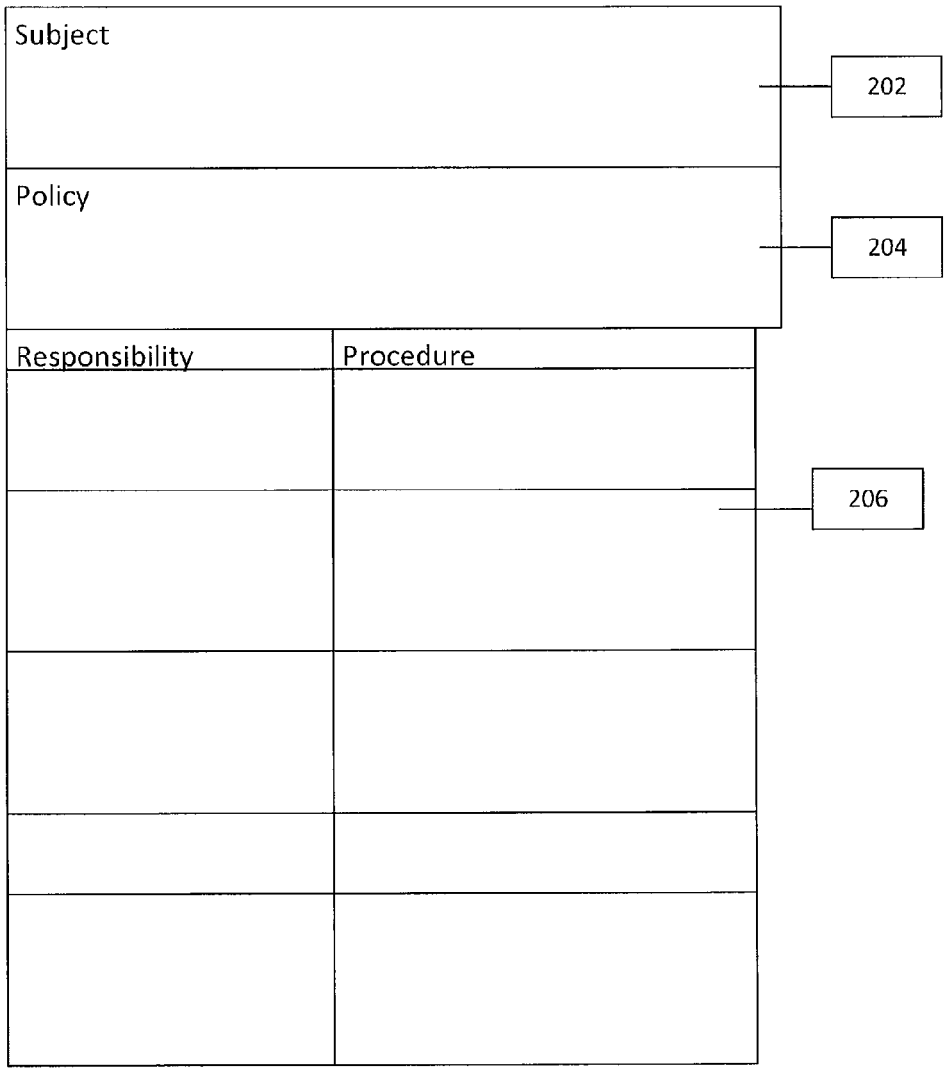
FIG. 2 shows an exemplary protocol for managing the administration of mother's colostrum and milk.

In FIG. 2, an exemplary protocol is shown that can be used to manage the oropharyngeal delivery. General information 202 about the method and the necessary supplies is contained in the Subject lines of the protocol. A Policy Statement 204 follows the general information. This Policy Statement 204 can be configured in a manner that is specific to the institution of clinic that has prepared the protocol. A Procedure 206 follows the Policy Statement 204 and defines the steps and responsibility for performing the protocol. Since many hospitals have specific protocol requirements, this exemplary protocol or an alternative can be included with any kit that contains the various components of the invention.

Figure 3A:
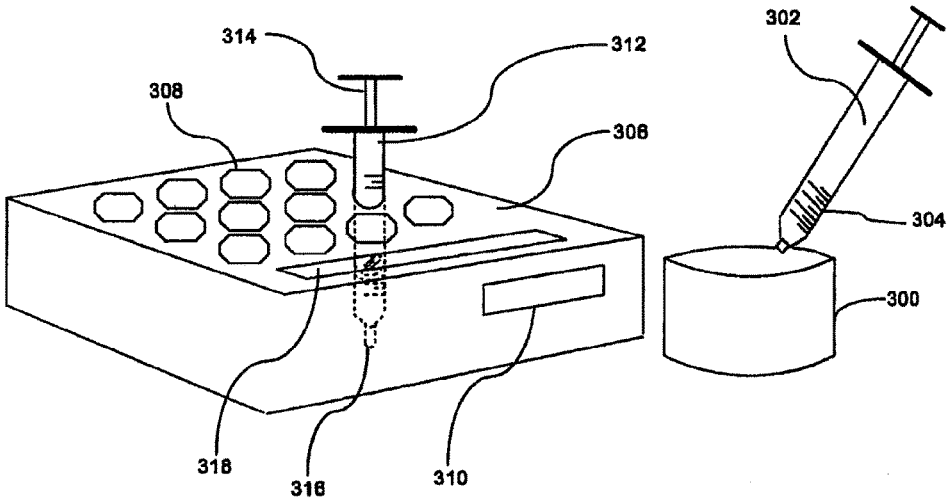
FIGS. 3A and 3B show an embodiment of a storage and delivery kit for the instant invention.

In FIG. 3A, one embodiment of the oropharyngeal OMC kit is shown. OMC is pumped or expressed into a sterile container 300 by the birth mother. Empty, sterile, disposable syringes 302 are used to draw up an appropriate volume of OMC from the container 300 using the volume markers 304 on the syringe 302 as a guide. A storage container 306 with a plurality of slots 308 and a location for attached labels 310 provides a place for the loaded syringes 312 to be stored until needed. The storage container 306 may include an equal number of slots 308 for the protocol, more slots 308 or less slots 308. In some embodiments, more than one storage container 306 may be used for the protocol. The slots 308 can be optionally numbered to provide guidance for the user on the ordering of the use of the loaded syringes 312. The slots 308 may be sized and shaped for the type of syringe that is included with the kit. Once the required numbers of loaded syringes 312 are placed into the slots 308, the kit can be placed into a refrigerator until needed. An optional cover 320 (shown in FIG. 3B) for the container 306 can be included to further reduce the potential for contamination, misuse or damage. The optional cover 320 can include a location for a label or labels to identify the unit and the patient. The slots 308 can be manufactured in a tapered fashion with the opening at the top larger and the opening decreasing in size towards the bottom of the slot 308 so that the loaded syringes 312 are held securely while the capped tips are not in contact with the sides of the storage container 306. The loaded syringes 312 may be stored in a vertical position with the plunger 314 at the top and the cannula 316 at the bottom although they may be stored in other acceptable orientations. Placing the loaded syringes 312 in this orientation reduces their exposure to handling and contamination. An optional slot 318 can be added to the storage container to hold sterile packaged swabs (not shown).

The storage container 306 and cover are made of plastic and can be transparent or opaque although any suitable material for use with medical devices and disposal as medical waste can be used. The storage container 306 can be manufactured and packaged so that it is sterile or capable of being sterilized to avoid a potential source of contamination.

The storage container 306 and/or the loaded syringes 312 can be optionally labeled with a bar code, mobile tag, action code, Quick Response (QR) code or other electronic coding system for use with a code reading device, a computer system and an electronic medical record system. This optional label allows the user to carefully track the timing of the administration of the OMC and verify that the patient is receiving the appropriate treatment.

Figure 3B:
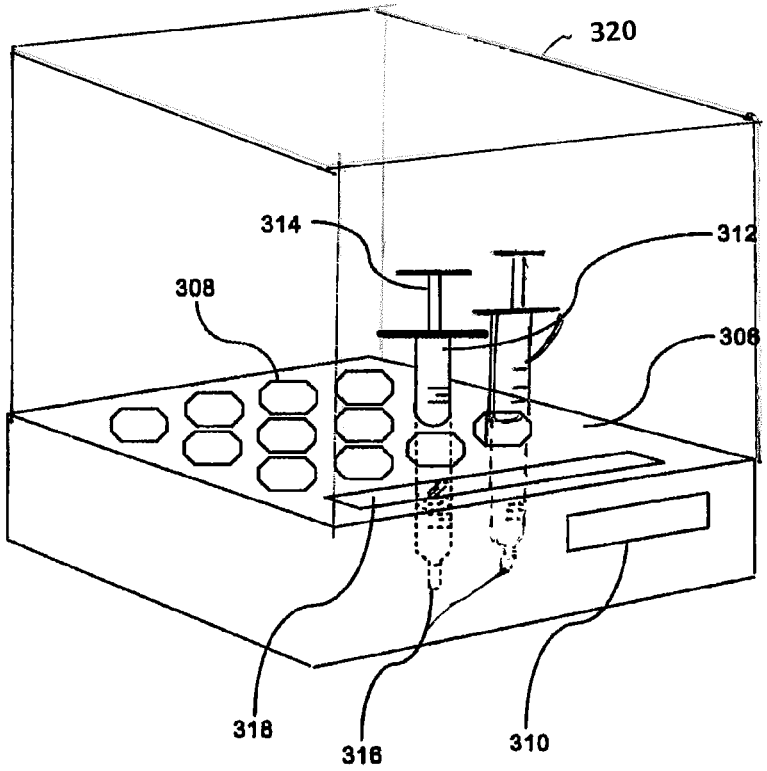
Figure 4:
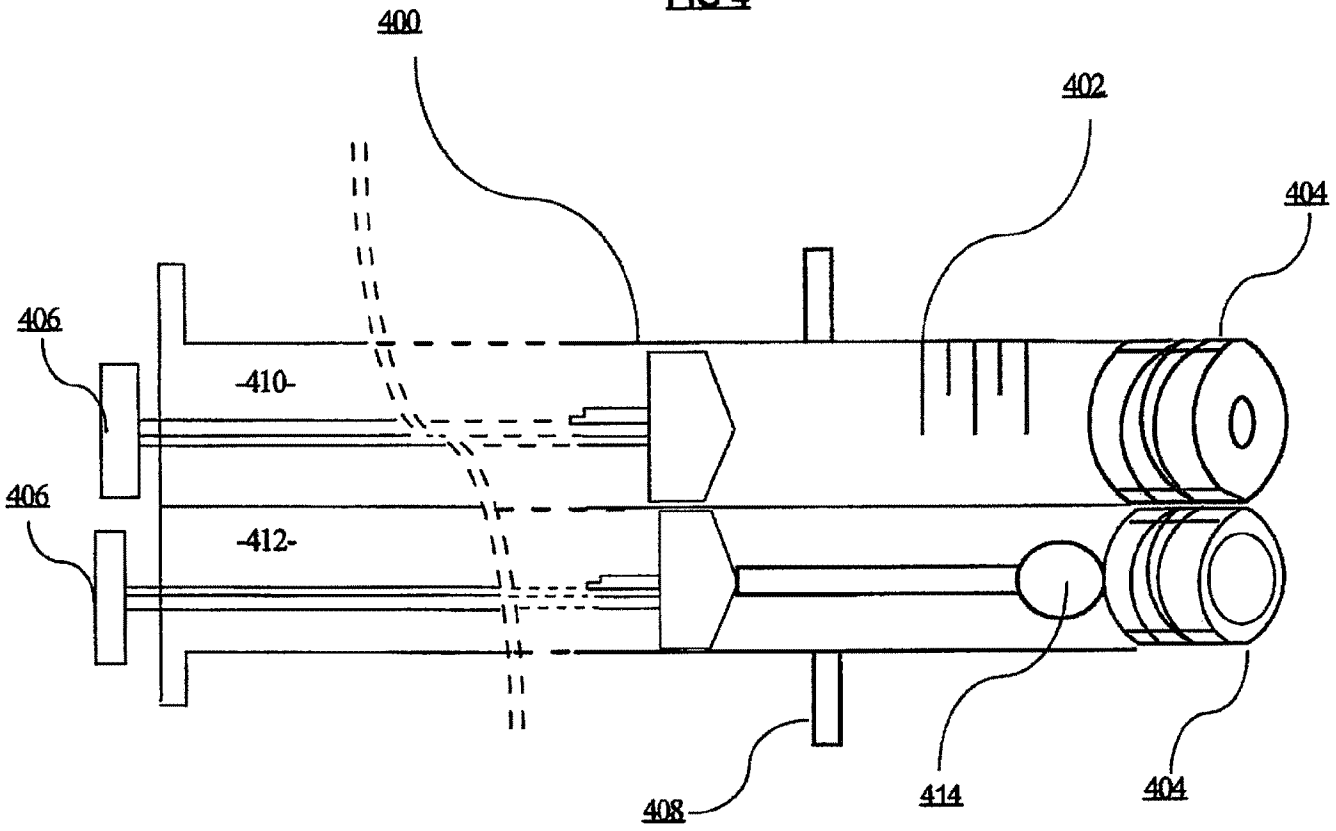
FIG. 4 shows one embodiment of a delivery device for the instant invention.

In FIG. 4 an embodiment of a partial view of a dual syringe device for use with the kit of FIGS. 3A and 3B is shown. A cut-away view of the dual syringe 400 with volume markers 402 on the first syringe 401, caps 404 and plungers 406 is shown in perspective. The individual syringe components of the dual syringe 400 can be removably attached through standard attachment means or can be manufactured so that they are permanently affixed. In an optional embodiment, the dual syringe 400 can contain one or more stabilizing bar(s) 408 that allows the loaded syringe to be stably placed in its storage container and reduce the possibility of dislocation, tipping or contact with the bottom of the container. The first syringe 401 and the second syringe 403 may be the same size or different sizes.

Furthermore, because there is a risk of possible contamination of the OMC through excessive handling outside of the sterile field, it is preferred to keep all components for delivery of the colostrum in close proximity. The dual syringe 400 contains on one side, a standard tuberculin style syringe 410 of the type described herein and an attached swab syringe 412 that holds the sterile swab 414 inside until required for delivery of the OMC to the infant. The syringe 410 and the syringe 412 may be the same size or different sizes.

A cap 404 or other sealable cover can be used on the swab syringe 412 to prevent the swab 414 from becoming contaminated before use. When the user begins the process of preparing the device for use, the user can remove the cap 404 on the tuberculin style syringe 410, insert the dual syringe 400 into the reservoir of OMC and use the plunger 406 on the tuberculin style syringe 410 to draw in a required amount of OMC. If a single syringe is used for both sides, the amount of OMC is at least double the amount that will be administered per cheek side so that the same dual syringe 400 can be used for both cheeks but can be 2.1×, 2.2×, 2.3×, 2.4×, 2.5×, 3×, 4× or greater. Alternatively, a syringe may be used for each side; two syringes per treatment. The cap 404 is secured. A label can be attached to the syringe containing such information as is required under the protocol. The now filled dual syringe 400 can be stored in a storage container as described herein.

When the user begins treating an infant with OMC per the protocol, the user removes the caps 404 from both the tuberculin style syringe 410 and the swab syringe 412. The plunger 406 on the tuberculin style syringe 410 is depressed sufficiently until the OMC is delivered to the oral (buccal) mucosal tissue. The plunger 406 on the swab syringe is depressed to move the swab 414 out of the swab syringe 412, and to extend the swab 414 onto the oral mucosa so that the swab can be used to evenly disperse the OMC over a period of about 5 seconds. This process is repeated for the other cheek, although the plunger 406 of the swab syringe 412 can be retracted first to return the swab 414 in the proper position wherein it can receive OMC from the tuberculin style syringe 410 without spillage. Alternatively, a new syringe (with swab) is used for the other cheek.

Although FIG. 4 shows the dual syringe 400 in a configuration wherein the tips of each syringe align with one another, it is contemplated that the tips of each syringe can be offset in a manner that reduces waste when the transfer of OMC is performed between the tuberculin style syringe 410 and the swab syringe 412. Likewise, the plungers 406 can be manufactured to be offset in a manner that prevents accidental depression of a plunger out of the proper order. Further each syringe in the dual syringe 400 combination can be manufactured with a different color code to make use of the device easier.

Figure 5:
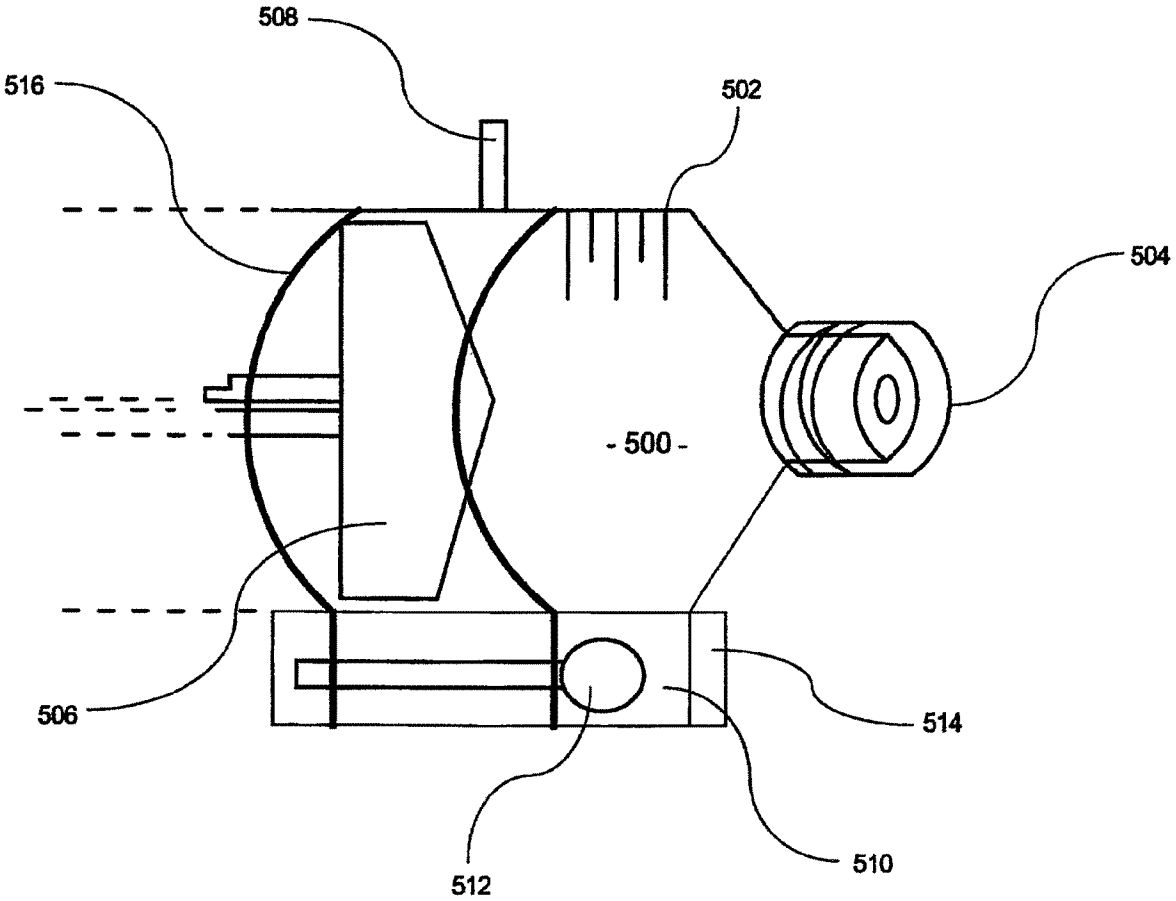
FIG. 5 shows an alternate embodiment of a delivery device for the instant invention.

In FIG. 5 an alternate embodiment of a partial view of a syringe for use with the kit of FIGS. 3A and 3B is shown. A cut-away view of the syringe 500 with volume markers 502, syringe cap 504 and plunger 506 is shown in perspective. In this embodiment only one syringe 500 is used. A tuberculin style syringe is preferred but any alternate syringe can be used. In an optional embodiment, the syringe 500 can contain a stabilizing bar 508 that allows the loaded syringe to be stably placed in its storage container and reduce the possibility of dislocation, tipping or contact with the bottom of the container.

Because there is a risk of possible contamination of the OMC through excessive handling outside of the sterile field, it is preferred to keep all components for delivery of the OMC in close proximity. The syringe 500 in this alternate embodiment is manufactured to contain an attached, closed and sterile container 510 that holds one or more swabs 512 inside until required for delivery of the OMC to the infant. A cap 514 or other sealable cover prevents the swab 512 from becoming contaminated before use. The container 510 can be made of plastic or other suitable materials. Attachment means 516 hold the closed container 510 to the syringe and can be permanent (e.g. heat sealed during manufacture) or temporary (e.g. bands).

When the user begins the process of preparing the device for use, the user can remove the cap 504 on the syringe 500, insert the syringe 500 into the reservoir of OMC and use the plunger 506 on the syringe 500 to draw in a required amount of OMC. The amount of OMC is at least the amount (1×) that will be administered per cheek side under the protocol so that the syringe can be used for one cheek but the amount of OMC can be 1.1×, 1.2×, 1.3×, 1.4×, 1.5× or greater. Where the same syringe 500 will be used for both cheeks, the amount of OMC is at least double (2×) the amount required for each cheek side per the protocol but can be 2.1×, 2.2×, 2.3×, 2.4×, 2.5×, 3×, 4× or greater. In this second scenario, at least two swabs 512 are contained in the container 510. The cap 504 is placed back onto the syringe 500. A label can be attached to the syringe containing such information as is required under the protocol. The now filled syringe 500 can be stored as described herein.

When the user begins the process of treating an infant with OMC, the user removes the cap 514 of the container, removes the syringe cap 504, remove(s) the swab(s) 512 and depresses the plunger 506 to deliver the proper amount of OMC to the oral (buccal) mucosa. This can be performed within a tight sterile field and without having to pick up additional supplies. The swab 512 is then used to evenly distribute the OMC that has been administered to the cheek mucosa of the patient. This process reduces the potential for contamination of the swab 512 or OMC and improves the outcome of the patient. A single device can be used for each cheek and holds at least one swab 512, although two or more swabs 512 can be included so that a new swab can be used for each cheek.

In an example of the use of oropharyngeal administration of mother's colostrum and milk, a recent publication[26] summarizes the evidence to date, supporting the benefits of this technique including protection against blood-stream infection, ventilator-associated pneumonia, and necrotizing enterocolitis, an earlier attainment of full enteral feeds, enhanced maturation of oral feeding skills, improved growth, and enhanced breastfeeding outcomes. A reduced time to reach full enteral feedings is clinically significant as this represents a potentially shorter length of hospitalization and decreased associated costs, in addition to a lower risk for infections (such as blood-stream infection) which are associated with significantly mortality, morbidity, and risk for adverse neurological outcomes. These findings suggest that ELBW infants, VLBW infants, ELGANS, LBW infants, term at-risk infants, and infants with compromised immune systems due to disease or genetic factors and normal term infants will all benefit from this method. The present disclosure relates to a delivery device and storage system for the oropharyngeal administration of mother's colostrum and milk so that patient safety is ensured and patient outcomes are enhanced.

The above Figures and disclosure are intended to be illustrative and not exhaustive. This description will suggest many variations and alternatives to one of ordinary skill in the art. All such variations and alternatives are intended to be encompassed within the scope of the attached claims. Those familiar with the art may recognize other equivalents to the specific embodiments described herein which equivalents are also intended to be encompassed by the attached claims.

REFERENCES

1. Mathews T J, MacDorman M F. Infant mortality statistics from the 2005 period linked birth/infant death data set. Natl Vital Stat Rep 2008; 57: 1.
2. WHO, March of Dimes, Partnership for Maternal, Newborn & Child Health, Save the Children. Born too soon: the global action report on preterm birth. www.who.int/maternal_child_adolescent/documents/born_too_soon/en/ (Accessed on May 4, 2012)
3. Blencowe H, Cousens S, Oestergaard M Z et al. National, regional, and worldwide estimates of preterm birth rates in the year 2010 with time trends since 1990 for selected countries: a systematic analysis and implications. Lancet 2012; 379: 2162.
4. Hamilton B E, Hoyert D L, Martin J A et al. Annual summary of vital statistics: 2010-2011. Pediatrics 2013; 131: 548.
5. Fanaroff A A, Stoll B J, Wright L L, et al. Trends in neonatal morbidity and mortality for very low birth weight infants. Am J Obstet Gynecol 2007; 196: 147.e.1
6. Horbar J D, Carpenter J H, Badger G J, et al. Mortality and neonatal morbidity among infants 501 to 1500 grams from 2000 to 2009. Pediatrics 2012; 129: 1019.
7. Martin J A, Hamilton B E, Sutton P D, Ventura S J, Mathews T J, Osterman M J K., Births: final data for 2008. Natl Vital Stat Rep 2010; 59: 1-72.
8. Gilbert W M, Nesbitt T S, Danielsen B. The cost of prematurity: quantification by gestational age and birthweight. Obstet Gynecol 2003; 102: 488-92.
9. Schmitt S K, Sneed L, Phibbs C S. Costs of newborn care in California: a population-based study. Pediatrics 2006; 117: 154-60.
10. Bureau of Labor Statistics. Consumer price index for all urban consumers and all items. 2009.Available at http: www.bls.gov/cpi/#tables. Accessed May 24, 2010.
11. Polin R A. Denson S. Brady M T. Committee on Fetus and Newborn. Committee on Infectious Diseases. Strategies for prevention of health care-associated infections in the NICU. [Review] *Pediatrics* 2012. 129(4):e1085-93
12. Cole C R. Hansen N I. Higgins R D. Ziegler T R. Stoll B J. Eunice Kennedy Shriver NICHD Neonatal Research Network. Very low birth weight preterm infants with surgical short bowel syndrome: incidence, morbidity and mortality, and growth outcomes at 18 to 22 months. Pediatrics 2008. 122(3):e573-82.
13. Payne, N R, Carpenter J H, Badger G J, Horbar J D, Rogowski J. Marginal increase in cost and length of stay associated with nosocomial bloodstream infections in surviving very low birth weight infants. *Pediatrics* 2004; 114 (2 part 1); 348-355.
14. Zhang Y, Ortega G, Camp M, Olsen H, Chang D C, Abdullah F. Necrotizing enterocolitis requiring surgery: outcomes by intestinal location of disease in 4371 infants. J Pediatr Surg. 2011; 46 (8): 1475-1481
15. Ganapthy V, Hay J W, Kim J H. Costs of necrotizing enterocolitis and cost-effectiveness of exclusively human-milk based products in feeding extremely premature infants. Breastfeed Med. 2012; 7 (1): 29-37.
16. Tarnow-Mordi W. Isaacs D. Dutta S. Adjunctive immunologic interventions in neonatal sepsis. [Review] [88 refs]. Clinics in Perinatology 2010; 37(2): 481-99.
17. Sisk P M, Dillard R G, Gruber K J, O'Shea T M. Early human milk feeding is associated with a lower risk of necrotizing enterocolitis in very low birth weight infants. *Journal of Perinatology* 2007; 27(12): 428-433.
18. Newburg D S, Walker W A. Protection of the neonate by the innate immune system of developing gut and of human milk. Pediatric Research 2007; 95 (6): 1075-81.
19. Schanler R J. Evaluation of the evidence to support the current recommendations to meet the needs of premature infants: the role of human milk. Am J Clin Nutr 2007; 85 (2): 625S-628S.
20. Patel A L, Johnson T J, Engstrom J L, Fogg L F, Jegier B J, Bigger H R, Meier P P. Impact of early human milk on sepsis and health-care costs in very low birth weight infants. Journal of Perinatology 2013; 1-6.
21. Meier P P. Engstrom J L. Patel A L. Jegier B J. Bruns N E. Improving the use of human milk during and after the NICU stay. Clinics in Perinatology 2010. 37(1):217-45.
22. Rodriquez N, Meier P, Groer M, Zeller J. Oropharyngeal administration of colostrum to extremely low birth weight infants: theoretical perspectives. *Journal of Perinatology* 2009; 29: 1-7.
23. Wagner C L. Taylor S N. Johnson D. Host factors in amniotic fluid and breast milk that contribute to gut maturation. Clinical Reviews in Allergy & Immunology 2008; 34(2):191-204.
24. Rodriguez N A, Meier P P, Groer M, Zeller J, Engstrom J, Fogg L. A pilot study to determine the safety and feasibility of oropharyngeal administration of own mother's colostrum to extremely low birth weight infants. Advances in Neonatal Care 2010; 10(4): 206-212.
25. Rodriguez N A, Meier P P, Groer M W, Zeller J M, Engstrom J L, Fogg, L., Du J., Caplan, M. A Randomized Clinical Trial of the Oropharyngeal Administration of Mother's Colostrum to Extremely Low Birth Weight Infants in the First Days of Life. *The Journal of Perinatology-Neonatology* 2011; 24 (4): 31-35.
26. Gephart S M, Weller M. Colostrum as Oral Immune Therapy to Promote Neonatal Health. Advances in Neonala Care. 2014; 14: 44-51.
27. Seigel J, Smith B, Ashley P, Cotton M, Herbert C, King B, Maynor A, Neill S, Wynn J, Bidegain M. Early Administration of Oropharyngeal Colostrum to Extremely Low Birth Weight Infants. *Breastfeeding Medicine.* 2013; 8: 1-5.

28. Thibeau S, Boudreaux C. Exploring the Use of Mother's Milk as Oral Care for Mechanically Ventilated Very Low Birth Weight Preterm Infants. *Advances in Neonatal Care.* 2013; 13: 190-197

29. Wilson S, Taylor C, Root K, Blackman A, Kaufman D. Oral care in the Neonate: One Step in a Bundle to Reduce Ventilator Associated Pneumonia (VAP). Presented at the Pediatric Academic Societies (PAS) 2012 Annual Meeting, April 28-May 1, 2012; Boston, Mass. E-PAS 2012: 1519.349.

30. Olsen J. Implementation of Oropharyngeal Administration of Colostrum in the NICU. Presented at the Vermont Oxford Network Annual Meeting, Dec. 3-4 2011; Washington, D.C.

31. McCallie K R, Lee H C, Mayer O, Cohen R S, Hintz S R, Rhine W D. Improved outcomes with a standardized feeding protocol for very low birth weight infants. Journal of Perinatology 2011, 31 Suppl 1:S61-S67.

32. Steffen E, K. Vangvanichyakorn, S. Sun. Implementing a bundle of Potentially Better Practices (PBP) to reduce NEC rate in VLBW infants. Presented at the Vermont Oxford Network Annual Meeting Dec. 3-4 2011; Washington D.C.

33. Caprio M C, Barr P A, Kim Y, Cruz H. Effects of establishing a feeding protocol to improve nutrition in premature neonates. Presented at the Pediatric Academic Societies (PAS) Annual Meeting, May 4-7, 2013; Washington, D.C.; E-PAS 2013: 3840.672.

The invention claimed is:

1. A delivery system for delivering colostrum or milk to an infant, the system comprising:

a syringe for delivering a dose of colostrum or milk, a dose of colostrum or milk provided in the syringe;

a swab container; and a swab, the swab contained in the swab container; the swab container connected to the syringe, wherein the swab comprises a pore size of about 100 pores/inch or less.

2. The delivery system according to claim 1, wherein the swab container is removably connected to the syringe.

3. The delivery system according to claim 1, wherein the syringe has a volume of about 1.0 mL or less.

4. The delivery system according to claim 1, wherein the swab comprises a smooth surface for contacting an oropharyngeal cavity surface of the infant.

5. The delivery system according to claim 1, wherein the swab container is a syringe.

6. The delivery system according to claim 1, wherein the system further comprises a stabilizing bar connecting the syringe and the swab container.

7. The delivery system according to claim 1, wherein one or more additional swabs are provided in the swab container.

8. The delivery system according to claim 1, further comprising a collection container for collecting the colostrum or milk from the mother or donor.

9. The delivery system according to claim 1, further comprising a storage container for storing the syringe having the colostrum or milk therein.

10. The delivery system according to claim 9, wherein the storage container comprises a plurality of slots for storing a plurality of syringes or a plurality of hangers for storing the plurality of syringes.

11. The delivery system according to claim 1, the delivery system further comprising an identification system.

* * * * *